US008215144B2

(12) United States Patent
Bulle

(10) Patent No.: US 8,215,144 B2
(45) Date of Patent: Jul. 10, 2012

(54) REPEATABLE BENDER ANGLE APPARATUS

(76) Inventor: Marshall R. Bulle, Rye, CO (US)

( * ) Notice: Subject to any disclaimer, the term of this patent is extended or adjusted under 35 U.S.C. 154(b) by 421 days.

(21) Appl. No.: 12/365,526

(22) Filed: Feb. 4, 2009

(65) Prior Publication Data

US 2009/0193864 A1 Aug. 6, 2009

Related U.S. Application Data

(60) Provisional application No. 61/026,240, filed on Feb. 5, 2008.

(51) Int. Cl.
*B21D 7/14* (2006.01)
*B21D 9/05* (2006.01)

(52) U.S. Cl. ..... 72/31.04; 72/149; 72/387

(58) Field of Classification Search ..... 72/31.04, 72/31.05, 31.1, 31.12, 149, 153, 155, 156, 72/159, 217, 219, 387, 388, 459, 461; 33/1 N, 33/529, 534, 538

See application file for complete search history.

(56) References Cited

U.S. PATENT DOCUMENTS

| | | | | |
|---|---|---|---|---|
| 2,906,032 | A * | 9/1959 | Holderer | 33/387 |
| 3,126,773 | A * | 3/1964 | Taylor, Jr. et al. | 72/31.05 |
| 3,584,492 | A * | 6/1971 | Dodge et al. | 72/217 |
| 4,372,145 | A * | 2/1983 | Giordano et al. | 72/387 |
| 5,931,039 | A * | 8/1999 | Yoshimizu et al. | 72/217 |

* cited by examiner

*Primary Examiner* — Teresa M Ekiert
(74) *Attorney, Agent, or Firm* — Nawrocki, Rooney & Sivertson, P.A.

(57) ABSTRACT

A manual and two pneumatic powered versions of bending apparatus with added indicator apparatus for indicating the bending arm angle, apparatus for rotating and locking the indicator apparatus at the rotated angle and stop means for stopping the bending arm at the rotated angle are provided. After a metal element is bent the bending force is removed, and the bend angle measured to determine if the required bend angle after spring back was obtained.

12 Claims, 7 Drawing Sheets

REPEATABLE BENDER ANGLE APPARATUS

CROSS-REFERENCE TO RELATED APPLICATIONS

This is a regular application filed under 35 U.S.C. §111(a) claiming priority, under 35 U.S.C. §119(e)(1), of provisional application Ser. No. 61/026,240, previously filed Feb. 5, 2008 under 35 U.S.C. §111(b).

BACKGROUND OF THE INVENTION

Several characteristics of metal make forming an identical bending angle in two or more metal strips or tubes using conventional bending apparatus quite difficult. One is the fact that metal must be bent beyond the desired angle because it springs back after the bending force is removed. Another complication is the fact that metals with different characteristics, such as the type of metal, the metal gage, and the metal cross-section, can each result in a different final bend angle even though initially bent to the same angle. In making bends in metal it would be desirable if successive equal angle bends could be made easily without requiring complex apparatus. Previous bending apparatus attempted to obtain identical bending angle by a stop which utilized a metal circle centered on the bending axis. Equally spaced holes around the periphery of the circle provided a location for a mating bolt. The bolt extended upward into the path of the bending arm to stop the bending arm at that angle. The problem with this approach was that the force generated by a hydraulic cylinder would damage the apparatus if the bending angle exceeded the bolt location. This problem has been overcome in the present apparatus.

SUMMARY OF THE INVENTION

The bending apparatus used can be powered either manually by a lever or by a hydraulic cylinder. The bending apparatus described here is representative of a number of benders known in the art. The repeatable bender apparatus incorporated into this bending apparatus is arranged to make multiple identical angle bends easily using either bender power source.

In the present apparatus a planar disk is used to provide an angular indicator to determine the bender arm angle. The disk is rotatably attached to the bending apparatus in a horizontal orientation by a centered cylinder mounted on the disk extending downward. The disk is mounted with its center directly below the bend axis of the bending arm. A manually adjustable two part split lock has a centered hole which mates with the cylinder for mounting the disk. This lock has an adjustment arranged to permit manually changing the spacing between the two parts of the split lock to change the grip of the lock on the cylinder.

The disk has equally spaced sequentially numbered radial lines on the upper surface of the disk. An indicator attached to the bender adjacent to the periphery of the disk points to the adjacent numbered radial lines or radial fractional divisions between the lines to indicate the bend angle of the bending arm. The lines are numbered rather than specifying an angle since bending metal with different characteristics to the same angle will produce different resulting angles as indicated hereinabove. Rotating the bending to a larger number results in a larger bend angle.

For a first embodiment a cylindrically shaped stop is attached to the disk periphery extending upward into the bending arm path. When the bending arm is rotated to the stop position this produces the desired bending angle. To set up a bend the lock around the cylinder attached to the disk is first released. The disk is then rotated to the required angle as indicated by the line and subdivision. A cylinder lock is then adjusted to secure the cylinder and attached disk until the force required to rotate them is greater than an operator can generate using a bending arm lever. With this arrangement, in order to make a number of equal bends in stock with similar characteristics, the operator need only reset the arm to its initial location, insert a new stock piece and then rotate the bending arm until it bears against the stop. The required line and subdivision location for the disk for any desired angle and stock with the same characteristics is first determined by trial and error.

When the bending apparatus uses hydraulic power to rotate the arm, the stop arrangement must be modified and a different operating procedure used. This is necessary because the force generated by a hydraulic cylinder is always adequate to rotate the disk regardless of the disk lock adjustment. For a second embodiment the stop is modified by having a spring loaded pin mounted within a recess in the stop facing the bending arm. The angle the bending arm rotates before reaching the stop defines a second angle before the disk will be rotated by the bending arm bearing against the stop. This provides an indicated interval to the operator to avoid rotating the disk.

Manual operation of the hydraulic system uses a manually operated foot valve mounted on top of the hydraulic fluid pump enclosure to control the bending arm. The foot valve controls the flow of the air from an air compressor to a hydraulic fluid pump. Pumping the hydraulic fluid extends the hydraulic cylinder to rotate the bending arm. The operator merely operates the foot control, which controls the air flow to the hydraulic fluid pump, to control the bending arm rotation. In order to obtain the desired bend angle, the operator uses the foot control to rotate the bending arm until the arm reaches the pin. Manual operation of the hydraulic system uses a manually operated foot valve mounted on top of the hydraulic fluid pump enclosure to control the bending arm. The foot valve controls the flow of the air from an air compressor to a hydraulic fluid pump. Pumping the hydraulic fluid extends the hydraulic cylinder to rotate the bending arm. The operator merely operates the foot control, which controls the air flow to the hydraulic fluid pump, to control the bending arm rotation.

In order to obtain the desired bend angle, the operator uses the foot control to rotate the bending arm until the arm reaches the pin. If the bending arm completely depresses the spring loaded pin and bears against the stop, the bending arm can rotate the disk and increase the bend angle beyond the desired angle even though secured by the cylinder-disk lock. This results because the force generated hydraulically is always great enough to rotate even a locked disk. However since the cylinder can rotate within the lock there is no damage to the apparatus. If this occurs, the operator can determine if the resulting bend is too excessive and whether that part should be discarded and whether the disk must be reset to the previous angle. The above process is repeated for all subsequent parts having the same characteristics to obtain the same desired bend for every part provided. The fact that the disk can rotate with no harm to the bending apparatus eliminates the problem with the present bending apparatus.

A third embodiment also uses a hydraulic cylinder to rotate the bending arm with the stop of the first embodiment replaced by a control valve. The control valve has an in-port which connects with an out-port. The control valve has a spring loaded extension which is urged outward from a mating recess in the valve toward the bending arm. When the extension is extended outward the control valve, this permits air to flow from the in-port to the out-port, but when the extension is depressed the valve will prevent air from flowing between the ports. An air compressor is connected by an air line to the input port of the control valve and the output port is connected by another air line to a hydraulic pump air connection. When the bending arm is rotated against the stop, the bending arm will depress the control valve extension into the stop. This will stop the flow of air to the hydraulic pump which will stop further rotation of the bending arm. This provides the same function that the operator did manually observing the spring loaded pin to know when to stop the bending process. This arrangement eliminates the human element and provides greater accuracy. The process of using a test part to obtain the number and any fractional subdivision and the system operation is essentially the same here as described hereinabove as previously for the first embodiment.

DETAILED DESCRIPTION OF THE INVENTION

There are three embodiments which relate to the method of stopping the bend at a selected angle. In the first embodiment the bending arm is powered manually and uses a simple cylinder to stop the bending arm at the desired angle. The second embodiment is powered by a hydraulic cylinder and uses a stop with a spring loaded extension. The extension provides information indicating to the operator where to stop the bending process before the part is bent too far. The third embodiment is also powering by a hydraulic cylinder but uses a control valve to stop an air source providing power to a hydraulic pump which stops the bending arm.

Figure 1:
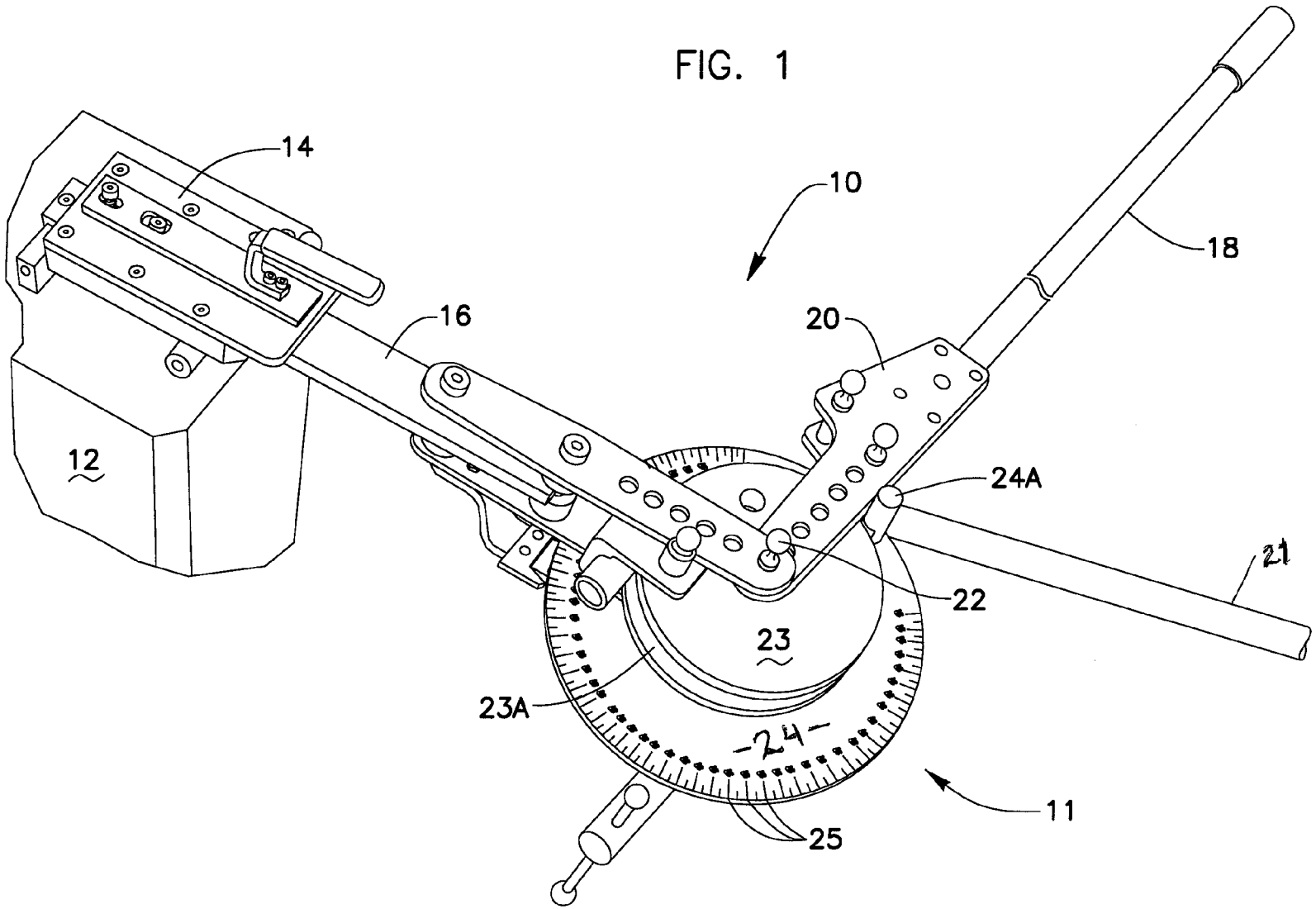
FIG. 1 is a top isometric view of the bending and repeatable bending apparatus.

The first embodiment is shown in FIG. 1. Here bending apparatus 10 is attached to mount 12 and the repeatable angle apparatus 11 attached the bending apparatus. Support arm 16 is attached extending outward from base 14. Bending apparatus 10 is manually operated by lever arm 18.

Lever arm 18 is attached to bending arm 20 which bends stock 21. The end of bending arm 20 opposite to lever arm 18 and the center of forming disk 23 have aligned holes sized to receive pivot pin 22. This permits rotating forming disk 23 and bending arm 20 around pin 22. Forming disk 23 has a groove 23A sized to receive a portion of the circular cross-section of cylindrical shaped stock 21.

A centered hole in angle indicator disk 24 also mates with and receives pin 22 permitting the disk to rotate around the pin. Stop 24A, which is cylindrical in shape, is attached near the periphery of angle indicator disk 24 extending upward into the path of bending arm 20.

Stop 24A limits the rotation of bending arm 20 to the stop location. This is required because in order to repeat a bend angle bending arm 20 must stop at the same rotation angle for each successive part. This also requires that angle indicator disk 24 be locked at this rotation angle and secured with enough force that the disk cannot be rotated manually past this angle by any force that can be exerted using lever arm 18. Index marks 25, and numbers described hereinafter, are used to set up apparatus 11 to make a predetermined size bend after the proper rotation angle has been determined by trial and error for a particular stock. Angle indicator disk 24 is then rotated to and locked at that angle. The lock is provided by disk lock 29 hereinafter described.

Figure 2:
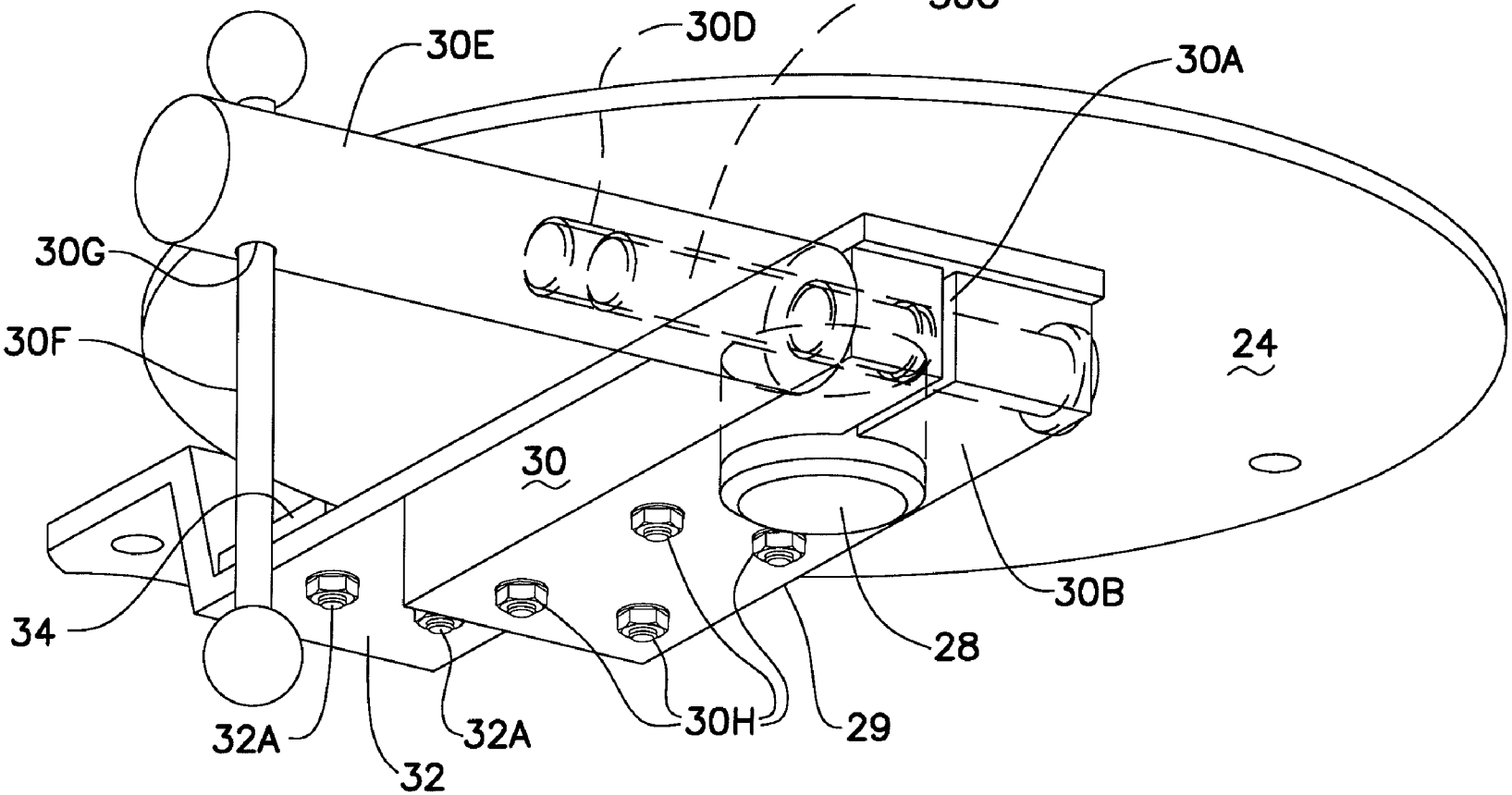
FIG. 2 is a bottom isomeric view of the repeatable bending apparatus for all embodiments.

Disk lock 29, shown in FIG. 2, is the same for all three embodiments of the invention. Here cylinder shaped extension 28 is attached perpendicular to angle indicator disk 24 with their respective centers aligned and the extension located below the disk. The rotation of extension 28 and attached angle indicator disk 24 are locked against rotation with respect to bending apparatus 10 with a predetermined force by disk lock 29.

Disk lock 29 has a support structure 30 with a split opening 30A on the end opposite to the attachment end extending past cylinder 28 with hole 30B enclosing the cylinder. A split 30A into hole 30B permits changing the hole size. Hole 30B is sized slideably fit around cylindrical extension 28 from angle indicator disk 24 unless the split opening 30A is partially closed. Threaded bolt 30C engages mating threaded hole 30D in rod 30E. Handle 30F is slideably mounted through hole 30G which extends through the end of rod 30E. With this arrangement rotating rod 30E using handle 30F will change the spacing of split opening 30A and change the gripping force of disk lock 29 on extension 28 and its attached angle indicator disk 24. For this embodiment the gripping force provided by disk lock 29 is greater than the force that can be exerted manually against stop 24A using lever arm 18.

Support structure 30 is attached to right angle bracket 32 by four bolts 30H through aligned mating holes and secured by mating nuts. Right angle bracket 32 has bolts 32A which extend through mating holes in the bracket, and pointer 34 is secured by mating nuts to attach the pointer to right angle bracket 32. Right angle bracket 32 and pointer 34 are secured to bending arm 16 with the pointer directed to the outer edge of disk 24 to indicate the angle of bending arm 20.

Figure 5:
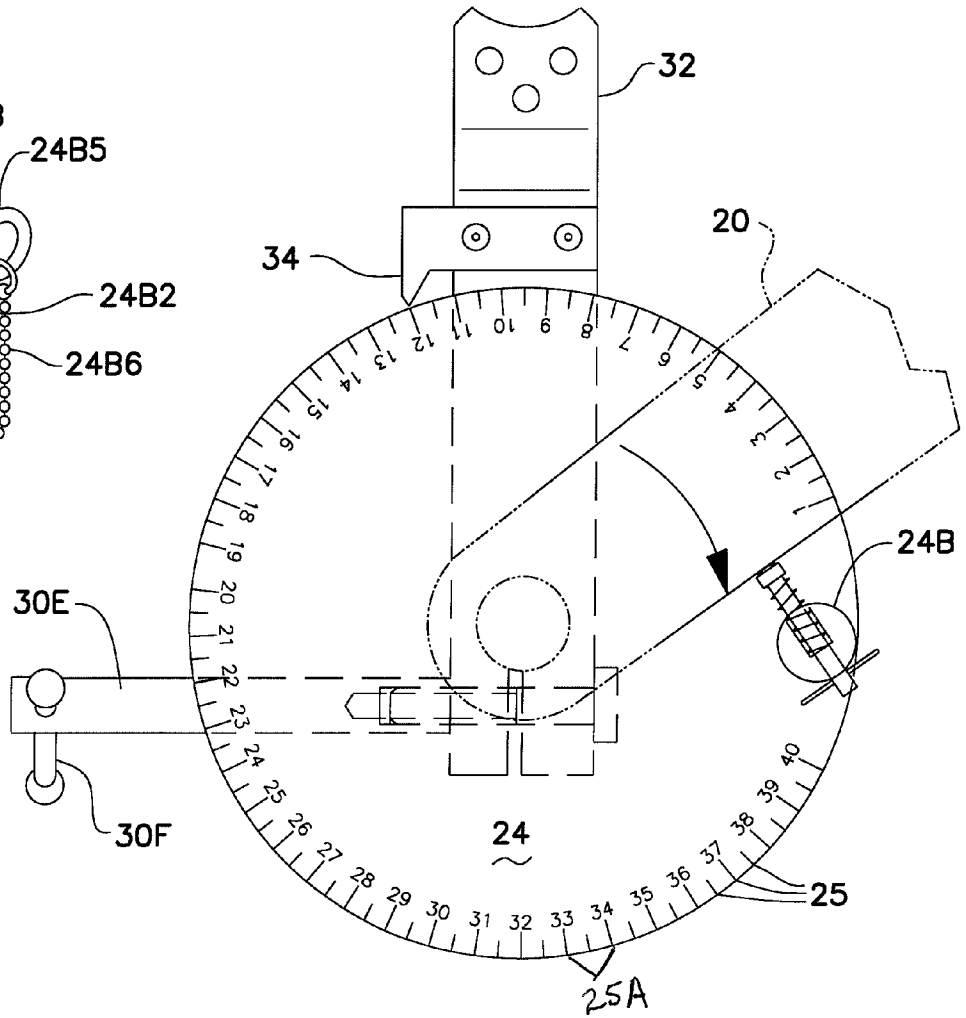
FIG. 5 is a top plan view of the repeatable bending apparatus for the second embodiment.

FIG. 5 shows index marks 25 and numbers 25A around the periphery of the angle indicator disk 24. Locating pointer 34 opposite to a larger number 25A will result in a larger bend angle. Numbers are used here rather than angles because the resulting angle for any given number will change for stock with different characteristics. To set up a predetermined angle disk lock 29, described hereinafter, is released using handle 30F and angle indicator disk 24 then positioned the disk at a predetermined angular location. For manual powered bending operation disk lock 29 is then tightened using handle 30F until a gripping force greater than lever 18 can produce is produced. Any number of stock items with the same characteristics can then be bent to the same angle using this set-up.

Figure 6:
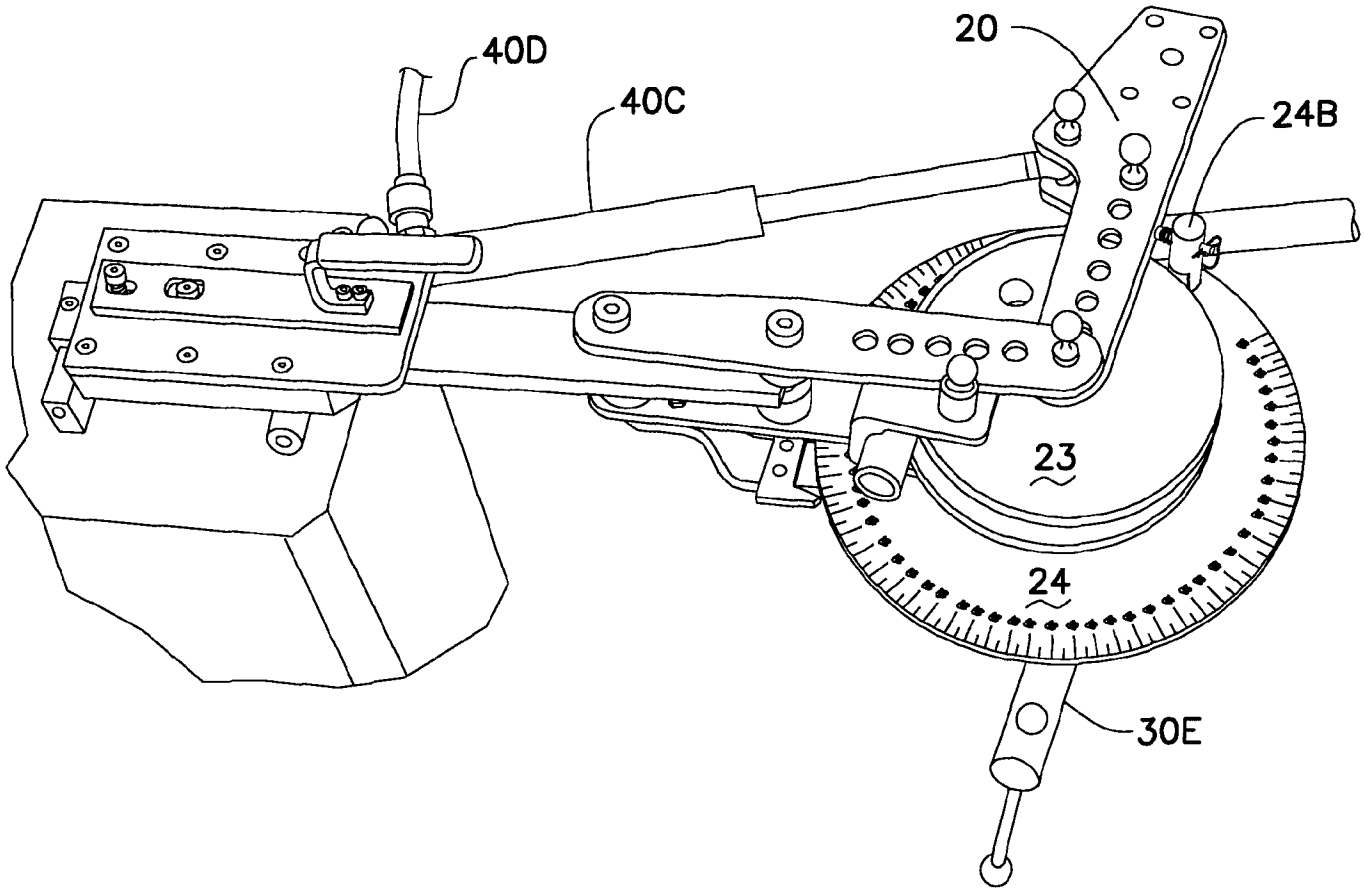
FIG. 6 is a top isometric view of the bending and repeatable bending apparatus for the second embodiment.

FIG. 6 shows apparatus 10 and apparatus 11 in the second embodiment with hydraulic cylinder 40C being used to rotate bending arm 20. For hydraulic powered bending operation disk lock 29 is still locked however this is done primarily to indicate the location of the desired bend angle, since the hydraulic power provided will always be great enough to overcome the lock.

Figure 3:
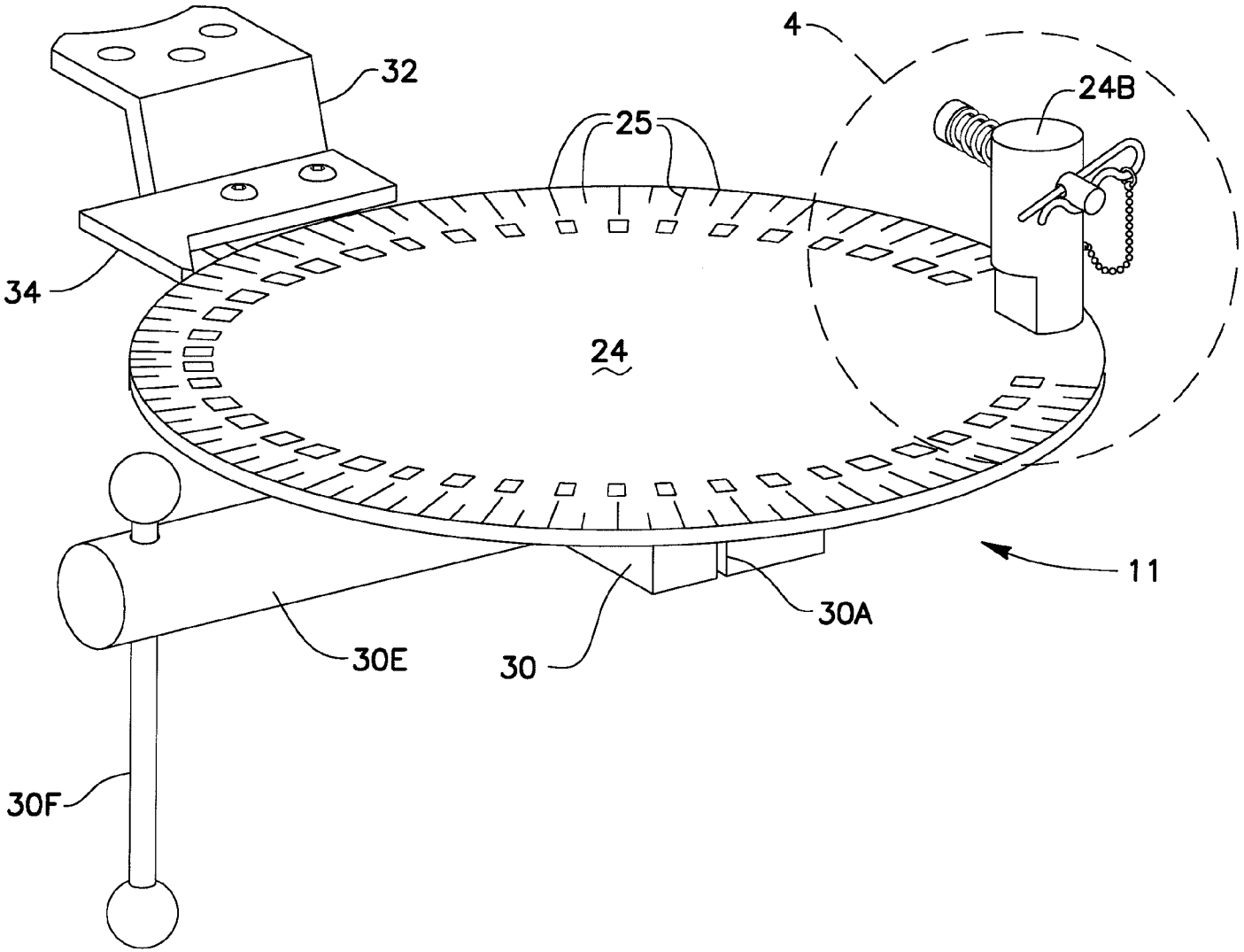
FIG. 3 is a top isometric view of the repeatable bending apparatus for the second embodiment.
Figure 4:
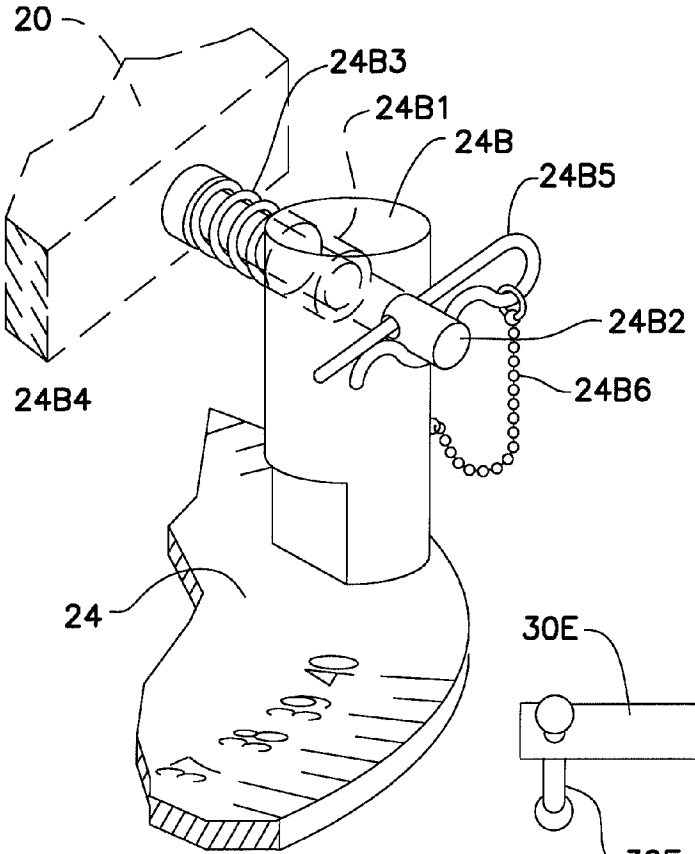
FIG. 4 is a top isometric view of a portion of the repeatable bending apparatus for the second embodiment.

Hydraulic cylinder 40C has a return spring to return the cylinder to the recessed position when pressure is removed. FIG. 3 shows apparatus 11, and FIGS. 4, and 5 show details of stop 24B.

The stop arrangement used in the second embodiment essentially provides an indication that the bending arm 20 is within a defined second angle adjacent to the desired first angle provided by the stop location. This defined second angle is provided by the apparatus shown in FIG. 4. Here stop 24B has a hole 24B1 extending through stop 24A perpendicular to its length with the portion on the end of the hole adjacent to bending arm 20 being larger than the opposite end. Head 24B4 is sized to slideably fit within the larger portion of hole 24B1. The portion of insert 24B adjacent to head 24B4 is reduced in size to accommodate coiled spring 24B3. The end of hole 24B1 opposite to bending arm 20 and the portion of insert 24B2 within that portion of the hole are both reduced in size with that portion of the insert 24B slideably engaging the adjacent portion of the insert. This prevents insert 24B from being forced outward through than end of hole 24B1 by spring 24B3. Insert 24B2, spring 24B3 and hole 24B1 are arranged to permit slideable movement of the insert within the hole and permit head 24B4 to slideably move from the location shown in FIG. 4 to a location where the outer end of head 24B4 is flush with hole 24B1. Retainer 24B5 prevents spring 24B3 from ejecting insert 24B2 when bending arm 18 is not adjacent to stop 24B. Chain 24B6 secures retainer 24B5 to stop 24B.

With this arrangement after bending arm 20 has rotated until it touches insert 24B2, the arm will then compress spring 24B3 until head 24B4 is flush with the adjacent end of hole 24B1. The angle that bending arm 20 travels trough from the location where bending arm 20 first touches insert 24B4 until head 24B2 is flush with hole 24B1 defines the second angle rotation. The location of bending arm 20 where head 24B4 is flush with hole 24B1 is the selected and locked first angle. The first angle is selected and locked using the same approach and arrangements in the second embodiment as was used in the first embodiment. The second angle interval will permit the operator to respond any time before bending arm 20 bears against stop 24 where it would begin to rotate angle indicator disk 24. However since angle indicator disk 24 can rotate there will be no damage to any part of apparatus 10 as would occur in current bending apparatus. This second angle adjacent to the selected and locked first angle essentially gives the operator an angle interval to stop the bending arm were there is no possibility of having to reset the angle indicator disk 24.

Figure 7:
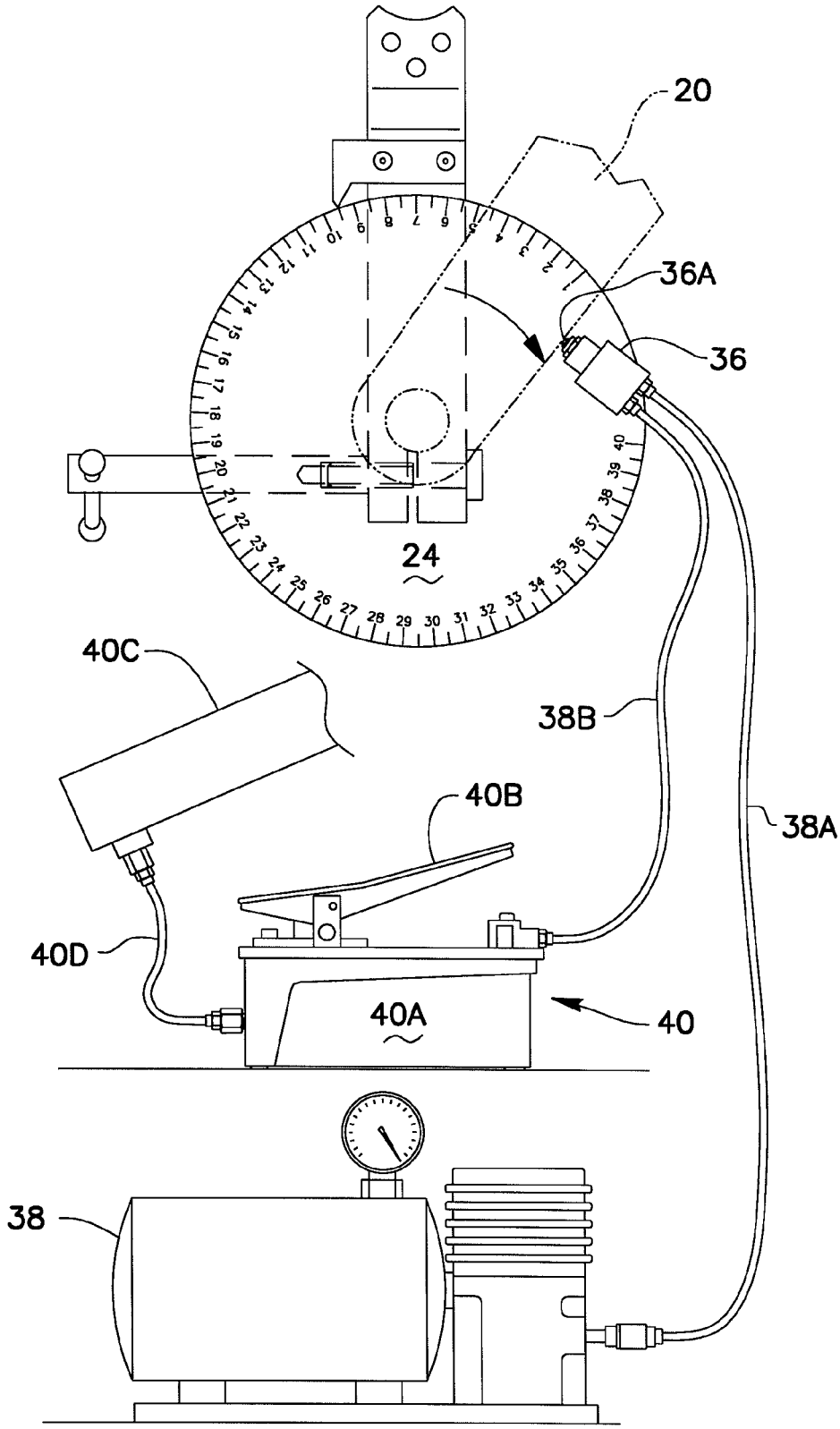
FIG. 7 is a top view of the repeatable bending apparatus for the third embodiment and a schematic of the pneumatic power equipment.
Figure 8:
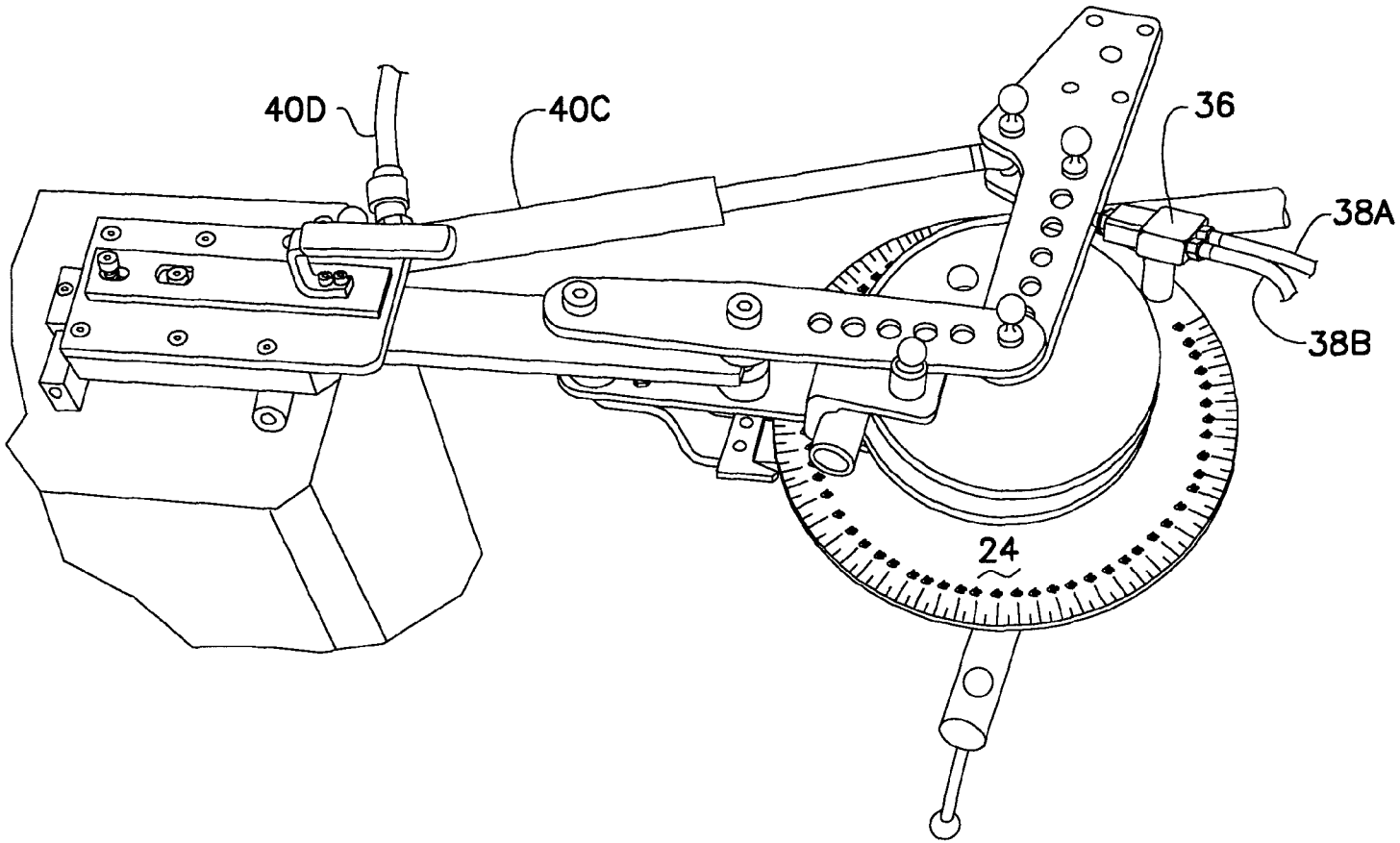
FIG. 8 is a top isometric view of the bending and repeatable bending apparatus for the third embodiment.

In the third embodiment shown in FIGS. 7 and 8, electrically powered air compressor 38 provides compressed air to control valve 36 through air hose 38A, and air hose 38B provides air from the control valve to foot control assembly 40. This contrasts with the second embodiment where air compressor 38 provides air directly to foot control assembly 40. Essentially control valve 36 in embodiment 3 is substituted for stop 24B in the first embodiment. As mentioned hereinabove the pneumatic powered system hydraulic cylinder 40C requires a spring return for proper operation, which is a common configuration. Control valve 36 has a spring loaded projection 36A facing bending arm 20. A control valve having the required characteristics is manufactured by Pneumadyne Inc. Part No. All-30-44. When extension 36A is extended air can flow through control valve 36 from air hose 38A to air hose 38B. When control valve extension 36 is depressed by bending arm 20 control valve 36 will close and prevent air from flowing from air hose 38A to air hose 38B which will stop the advance of bending arm 20 at that angular rotation as hereinafter described. This arrangement will also repeat the same bend angle for stock having the same characteristics until angle indicator disk 24 is rotated and control valve 36 repositioned at a different angle.

Foot control assembly 40 has a base 40A containing a hydraulic fluid storage tank and an air driven pneumatic pump controlled by the position of foot control 40B. A foot control assembly having the required characteristics for foot control 40B is manufactured by Shin Fu of Taiwan for BVA Hydraulics Part # PA1500. Hydraulic fluid pumped by assembly 40 is forced through hose 40D to hydraulic cylinder 40C.

With this arrangement when bending arm 20 depresses control valve extension 36A, the flow of air to rotate bending arm 20 will automatically stop. This will result in the same bend angle being formed successively in stock having similar characteristics. Again the location of control valve 36 can be determined by trial and error for stock with any given characteristics identical to the previous procedures used to obtain the previous stop locations. The fact that cylinder 40C has a return spring permits resetting the cylinder by merely releasing pressure to the cylinder using foot control 40B after the hydraulic fluid flow is stopped.

Incorporating repeatable bending apparatus into conventional bending apparatus, which can be either lever or hydraulically powered, requires only simple apparatus to obtain the same angle bend for any number of successive bends of stock which have the same characteristics. The set-up is also simple requiring only rotating and locking the disk at a predetermined location relative to the disk numbers and index marks. The required disk location can easily be determined by trial and error, and once determined can be provided to the user as part of a plan. This greatly simplifies constructing apparatus requiring a number of equal angle bends in a number of similar stock pieces.

The above embodiments are just a few examples of the modifications and changes that are possible and would readily occur to one skilled in the art, therefore it is contemplated that the appended claims will cover any such modifications or embodiments as fall within the true scope of the invention.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. Apparatus for repeating the same bend angle in similar metal stock pieces comprising:

a) manually powered metal bending apparatus;

b) angle indicator means attached to said metal bending apparatus for indicating a bending arm angle of said bending apparatus around its bending path, further having rotation means for rotating said angle indicator means to any selected bending arm angle, and also having rotation locking means for locking said angle indicator means at any selected bending arm angle; and c) stop means attached to said angle indicator means for stopping the bending arm at any selected and locked angle of said angle indicator means;

d) wherein said angle indicator means comprises a disk, and wherein said disk rotation means comprises said disk being rotatably mounted on said bending apparatus with the disk essentially parallel to and immediately within the plane of rotation of said bending arm with the disk center located at the bend axis;

e) wherein a disk has disk rotation and rotation locking means comprising a cylinder having a perpendicular end attached perpendicular to said disk on the side opposite to the bending arm with the disk and cylinder centers aligned; and f) a support structure attached to said bending apparatus extending outwardly past said cylinder having a hole enclosing said cylinder, with the side of said hole opposite to said bending apparatus having a split opening, said split opening having manual adjusting means for changing the spacing of said opening from a maximum where the opening slideably encloses said cylinder to a minimum where the opening grips the cylinder with a force greater than any which can be generated manually to rotate the bending arm.

2. Apparatus as in claim 1 wherein said disk has a plurality of equally spaced sequentially numbered radial indicator marks around the surface of the disk near the disk periphery on the side adjacent to the bending arm with radial fractional indicator marks therebetween, and wherein said bending apparatus has a pointer attached thereto directed toward said marks indicating the rotation of the bending arm with respect to the bending apparatus.

3. Apparatus as in claim 1 wherein said stop means comprises an extension mounted on the surface of said disk near the disk periphery on the side adjacent to the bending arm extending outward into the bending path of said bending arm.

4. Apparatus for repeating the same bend angle in similar metal stock pieces comprising:

a) pneumatically powered metal bending apparatus;

b) angle indicator means attached to said metal bending apparatus for indicating a bending arm angle of said bending apparatus around its bending path, further having rotation means for rotating said angle indicator means to any bending arm angle, and also having angle indicator locking means for locking said angle indicator means at any bending arm angle;

c) a stop means comprising a stop extension attached to said angle indicator means for indicating a locked angle; and d) a stop angle indicator means comprising an extension attached to the stop extension for indicating a predetermined distance from the stop angle indicator to the bending arm providing stop information to the operator to assist in manually stopping the bending arm within that distance.

5. Apparatus as in claim 4 wherein said angle indicator means comprises a disk, and wherein said disk rotation means comprises said disk being rotatably mounted on said bending apparatus with the disk essentially parallel to and immediately within the plane of rotation of said bending arm with the disk center located at the bend axis.

6. Apparatus as in claim 5 wherein said disk has a plurality of equally spaced sequentially numbered radial indicator marks around the surface of the disk near the disk periphery on the side of the disk adjacent to the bending arm with radial fractional indicator marks therebetween, and wherein said bending apparatus has a pointer attached thereto directed toward said marks indicating the rotation of the bending arm with respect to the bending apparatus.

7. Apparatus as in claim 5 wherein a disk rotation means comprises:

a) a cylinder having a perpendicular end with said perpendicular end being attached perpendicular to said disk on the side opposite to the bending arm with the disk and cylinder centers aligned; and b) wherein said disk rotation locking means comprises a support structure attached to said bending apparatus extending outwardly past said cylinder having a hole enclosing said cylinder, with the side of said hole opposite to said bending apparatus having a split opening, said split opening having manual adjusting means for changing the spacing of said opening and change the locking force.

8. Apparatus as in claim 4 wherein said stop means comprises a stop extension mounted on the surface of said disk adjacent to the disk periphery on the side adjacent to the bending arm extending outward into the bending path of said bending arm.

9. Apparatus as in claim 8 wherein the stop extension mounts a spring loaded extension located within a mating opening which extends outward a predetermined length towards said bending arm, having a length such that the bending arm will rotate through a predetermined distance extending from contact with the extension to where the spring loaded extension is forced into a mating opening by the bending arm to provide visual information to the operator for stopping the bending angle within this distance.

10. Apparatus for repeating a selected bend angle in similar metal stock pieces comprising:

a) pneumatically powered metal bending apparatus;

b) angle indicator means attached to said metal bending apparatus for indicating a bending arm angle of said bending apparatus around its bending path, further having rotation means for rotating said angle indicator means to any selected bending arm angle, and also having locking means for locking said angle indicator means at any selected bending arm angle; and c) stop means attached to said angle indicator means for stopping the bending arm at any selected and locked angle of said angle indicator means;

d) wherein said angle indicator means comprises a disk, and wherein said disk rotation means comprises said disk being rotatably mounted on said bending apparatus with the disk essentially parallel to and immediately within the plane of rotation of said bending arm with the disk center located at the bend axis;

e) wherein said rotation means and rotation locking means comprises a cylinder having a perpendicular end with said perpendicular end being attached perpendicular to a disk on the side opposite to said bending arm with the disk and cylinder centers aligned; and f) a support structure attached to said bending apparatus extending outwardly past said cylinder with said support structure having a hole enclosing said cylinder, with the side of said hole opposite to said bending apparatus having a split opening, said split opening having manual adjusting means for changing the spacing of said opening and change the locking force.

11. Apparatus as in claim 10 wherein said disk has a plurality of equally spaced sequentially numbered radial indicator marks around the surface of the disk near the disk periphery on the side of the disk adjacent to the bending arm with radial fractional indicator marks therebetween, and wherein said bending apparatus has a pointer attached thereto directed toward said marks indicating the rotation angle of the bending arm with respect to said bending apparatus indicating the rotation of the bending arm with respect to the bending apparatus.

12. Apparatus for repeating a selected bend angle in similar metal stock pieces comprising:

a) pneumatically powered metal bending apparatus;

b) angle indicator means attached to said metal bending apparatus for indicating a bending arm angle of said bending apparatus around its bending path, further having rotation means for rotating said angle indicator means to any selected bending arm angle, and also having locking means for locking said angle indicator means at any selected bending arm angle; and c) stop means attached to said angle indicator means for stopping the bending arm at any selected and locked angle of said angle indicator means;

d) wherein said stop means comprises an extension mounted on the surface of the disk near the disk periphery, on the side adjacent to the bending arm extending outward into the path of said bending arm; and e) a valve with a spring loaded extension arranged to stop air flow between an entry and an exit port, when said spring loaded extension is depressed a predetermined amount it will stop the air flow which will stop the rotation of said bending arm, said extension mounting said valve within a mating recess with the spring loaded extension facing said bending arm extending outward such that the bending arm will at least depress said valve extension a predetermined amount from where the bending arm first touches said spring loaded extension to where the spring loaded extension is depressed into said recess by the bending arm and cause the valve to stop air flow between said entry and said exit ports and stop the bending arm.

* * * * *